US010262824B2

(12) United States Patent
Matsuo et al.

(10) Patent No.: US 10,262,824 B2
(45) Date of Patent: Apr. 16, 2019

(54) OPERATION COIL DRIVE DEVICE OF ELECTROMAGNETIC CONTACTOR

(71) Applicant: FUJI ELECTRIC FA COMPONENTS & SYSTEMS CO., LTD., Tokyo (JP)

(72) Inventors: Naoyuki Matsuo, Hachioji (JP); Akira Morita, Kokubunji (JP); Takahiro Taguchi, Kounosu (JP); Kosuke Ishibashi, Konosu (JP)

(73) Assignee: FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 15/938,829

(22) Filed: Mar. 28, 2018

(65) Prior Publication Data

US 2018/0218862 A1 Aug. 2, 2018

Related U.S. Application Data

(63) Continuation of application No. PCT/JP2017/002965, filed on Jan. 27, 2017.

(30) Foreign Application Priority Data

Mar. 17, 2016 (JP) ..... 2016-054020

(51) Int. Cl.
*H01H 47/32* (2006.01)
*H01H 47/22* (2006.01)
*F02D 41/20* (2006.01)

(52) U.S. Cl.
CPC ..... *H01H 47/325* (2013.01); *H01H 47/223* (2013.01); *H01H 47/32* (2013.01); *F02D 2041/2058* (2013.01)

(58) Field of Classification Search
CPC ..... H01H 47/325; H01H 47/223; H01H 47/32
See application file for complete search history.

(56) References Cited

U.S. PATENT DOCUMENTS 4,823,825 A 4/1989 Büchl
4,878,147 A * 10/1989 Oyama ..... H01H 47/325 361/154

(Continued)

FOREIGN PATENT DOCUMENTS

JP 61-250309 11/1986
JP 62-35424 2/1987

(Continued)

OTHER PUBLICATIONS

English Translation by WIPO of the International Preliminary Report on Patentability dated Sep. 27, 2018 for International Patent Application No. PCT/JP2017/002965, 6 pgs.

(Continued)

*Primary Examiner* — Scott Bauer

(57) ABSTRACT

Operation coil drive device of electromagnetic contactor includes current detector and drive controller. The detector, when switching control is performed on operation coils of the contactor, detects coil current flowing through the coils. The controller controls an on/off time ratio of a semiconductor switching element wherein the on/off time ratio during close circuit control becomes larger than the on/off time ratio during holding control. Power supply voltage is switchingly applied to the coils at the on/off time ratio. The controller includes a determination locus setter and a close circuit state determiner. The setter sets a determination locus that continuously increases along a change locus of detected coil current during close circuit control. The determiner determines a contact point close circuit state by contact of a movable contact to a fixed contact based on deviation (Continued)

between the determination locus by the setter and the detected coil current detected.

7 Claims, 7 Drawing Sheets

(56) References Cited

U.S. PATENT DOCUMENTS

| | | | | |
|---|---|---|---|---|
| 5,737,172 | A * | 4/1998 | Ohtsuka | H01H 47/325 307/128 |
| 5,812,355 | A * | 9/1998 | Nojima | H01F 7/1805 361/152 |
| 5,818,679 | A | 10/1998 | Schustek et al. | |
| 7,740,225 | B1 * | 6/2010 | Estelle | F16K 31/0665 251/129.05 |
| 8,576,534 | B2 | 11/2013 | Choi | |
| 2013/0021713 | A1 | 1/2013 | Choi | |
| 2016/0358732 | A1 * | 12/2016 | Nishio | H01H 47/002 |

FOREIGN PATENT DOCUMENTS

| | | |
|---|---|---|
| JP | 1-132108 | 5/1989 |
| JP | 5-101925 | 4/1993 |
| JP | 11-503862 | 3/1999 |
| JP | 2009-127849 | 6/2009 |
| JP | 2009-289690 | 12/2009 |
| JP | 2013-26217 | 2/2013 |
| JP | 2015-133298 | 7/2015 |

OTHER PUBLICATIONS

International Search Report dated Apr. 25, 2017 in corresponding International Patent Application No. PCT/JP2017/002965.

* cited by examiner

OPERATION COIL DRIVE DEVICE OF ELECTROMAGNETIC CONTACTOR

CROSS-REFERENCE TO RELATED APPLICATIONS

This application is a continuation application, under 35 U.S.C. § 111(a), of international application No. PCT/JP2017/002965, filed Jan. 27, 2017, which is based on and claims foreign priority to Japanese patent application No. 2016-054020, filed Mar. 17, 2016, the entire disclosures of which are herein incorporated by reference as a part of this application.

TECHNICAL FIELD

The present invention relates to an operation coil drive device of an electromagnetic contactor that opens and closes a current supplied to an electrical load device such as an electric motor.

BACKGROUND ART

An electromagnetic contactor generates an attraction force to attract a movable iron core to a stator iron core through energization of an operation coil constituting an electromagnet device to cause a movable contact to contact/separate from a fixed contact. This opens and closes an electric circuit between a single-phase power supply and a three-phase power supply and a load device.

Conventionally, coil driving circuits used for the electromagnetic contactor have been variously proposed (for example, see PTLs 1 to 3).

PTL 1 discloses a coil driving device of an electromagnet that includes a semiconductor switching element, which supplies an operation coil with a power supply voltage, a voltage detection circuit, which detects the power supply voltage, a gain circuit, which outputs an input level signal according to the detection voltage by this voltage detection circuit and outputs a holding level signal higher than the input level signal based on the detection voltage after a set period, a reference wave generating circuit, which generates a sawtooth wave, a comparator, which compares the sawtooth wave from this reference wave generating circuit with the input level signal from the gain circuit, compares the sawtooth wave with the holding level signal after an elapse of an output setting period of an input pulse signal at a fixed cycle, and outputs a holding pulse signal with an on/off time ratio (also referred to as a duty ratio) smaller than that of the input pulse signal, and a pulse output circuit, which supplies this input pulse signal from the comparator and the holding pulse signal to the semiconductor switching element.

That is, this PTL 1 discloses the following technology. Since a large attraction force is required in a close circuit control in which an iron core gap of the electromagnet is large (that is, a fixed contact point is separated from a movable contact point), a coil is excited at a large current. Meanwhile, in a holding control in which an iron core enters an attracted state and an iron core gap is absent, since maintaining the attracted state is possible even if the operation coil is excited at a comparatively small current, a coil current is reduced as much as possible to lower the electric power consumption.

PTL 2 discloses the following technology. An integrating circuit constituted of a capacitor and a resistor integrates a voltage applied to an operation coil during driving of an electromagnetic relay. After an elapse of a period according to a time constant of the integrating circuit, the applied voltage is lowered to lower electric power for the operation coil driving. The integrating circuit here performs the integration with the capacitor to which the applied voltage to the electromagnetic relay is arbitrarily set and the resistor. The integrating circuit is not a circuit to detect the operation of the operation coil of the electromagnetic relay but is a timed circuit to set the period from the applied voltage to the operation coil.

PTL 3 discloses an electromagnet device that includes switch means, which flows an exciting current to an operation coil when a power supply voltage at a start of power-on exceeds a determination value, detecting means of the exciting current, a timer circuit for an operation setting time in inverse proportion to a magnitude of the power supply voltage, which starts operating when the detection value by this detecting means exceeds the determination value, and means, which controls the switch means after an elapse of the operation setting time by this timer circuit to flow a holding operation current to the operation coil.

That is, conventional examples described in PTL 3 describes (1) a technology that controls a voltage to be in inverse proportion to a switching period from power-on to the holding state such that the switching period becomes short while the applied voltage is high and the switching period becomes long such while the applied voltage is lowered to reduce an impact during the application of the power supply, (2) a technology that measures an impedance of the operation coil to determine timing at which the operation coil of the electromagnetic contactor is switched to the holding operation and controls the operation to the operation coil holding operation when the impedance increases and the electromagnet attracts, and (3) a technology that prepares a high-frequency power supply to apply a high-frequency voltage to a coil different from a coil of operation coil driving to measure the operation coil impedance, and measures a current flowing through the operation coil by this high-frequency voltage to measure the impedance of the operation coil from a change in high-frequency current.

CITATION LIST

Patent Literature

PTL 1: JP 1-132108 A
PTL 2: JP 62-35424 A
PTL 3: JP 5-101925 A

SUMMARY OF INVENTION

Technical Problem

However, the conventional operation coil drive device of the electromagnetic contactor has the following problems. Usually, during a close circuit operation in which the electromagnetic contactor changes from an off-state to an on-state, a large coil current is flown to cause a movable iron core to transition from a release state to an attracted state. When the movable iron core enters the attracted state, the control operation is switched to lower an operation coil current. As a method for switching the control operation, a method of using a position sensor to detect the attracted state of the movable iron core and a method of using a timer set so as to match a period until the absorption of the movable iron core are employed.

Although the method using the position sensor is reliable in operation, the sensor to detect a position of the iron core is required separately. Additionally, the period until the absorption of the movable iron core varies depending on a variation of a power supply voltage, a variation of a coil resistance due to a temperature conversion caused by a change in ambient temperature and self-heating of the operation coil, and an influence from a mounting direction of the electromagnetic contactor. In view of this, the method of using the timer requires setting by which the control operation is reliably switched after the iron core absorption even under such worst conditions. Therefore, a time limit of the timer for switching the control operation is set sufficiently longer than the iron core absorption period. Consequently, since a large current flows to an operation coil control circuit element for the period equal to or more than the absorption period of the iron core during a close circuit control, a rating of the circuit element becomes larger compared with the switching of the control operation by the absorption position detection of the iron core.

Conventionally, to solve this problem, an attraction force of the operation coil is generally lowered by adjusting the applied power supply voltage. However, since the operation coil current during the close circuit control and the holding control is affected by the variation factors other than the power supply voltage such as a variation in coil resistance value and a change in coil resistance due to a rise in coil temperature; therefore, conventionally, the sufficient effect cannot be obtained actually.

The present invention has been made focusing on the problems of the conventional examples and an object of the present invention is to provide an operation coil drive device of an electromagnetic contactor that can reliably detect an attracted state of a movable iron core without the use of a position sensor and a timer.

Solution to Problem

To achieve the object, one aspect of an operation coil drive device of an electromagnetic contactor according to the present invention includes an electromagnetic contactor, a current detector, and a drive controller. The electromagnetic contactor includes a movable contact disposed connectable to and separable from a fixed contact. The electromagnetic contactor is configured to apply a power supply voltage to an operation coil wound around a stator iron core by switching control. The stator iron core is configured to attract a movable iron core. The movable iron core is configured to cause the movable contact to move. The current detector is configured to detect a coil current flowing through the operation coil by the switching control. The drive controller is configured to control an on/off time ratio of a semiconductor switching element such that the on/off time ratio during a close circuit control becomes larger than the on/off time ratio during a holding control. A power supply voltage is switchingly applied to the operation coil at the on/off time ratio. The drive controller includes a determination locus setting unit and a close circuit state determining unit. The determination locus setting unit is configured to set a determination locus that continuously increases along a change locus of the coil current detected by the current detector during the close circuit control. The close circuit state determining unit is configured to determine a contact point close circuit state by a contact of the movable contact to the fixed contact based on a deviation between the determination locus by the determination locus setting unit and the coil current detected by the current detector.

Advantageous Effects of Invention

According to one aspect of the present invention, disposing a determination locus setting unit to set a determination locus allows reliable detection of a contact point close circuit state caused by a contact of a movable contact with a fixed contact without the use of a position sensor and a timer.

DESCRIPTION OF EMBODIMENTS

Figure 1:
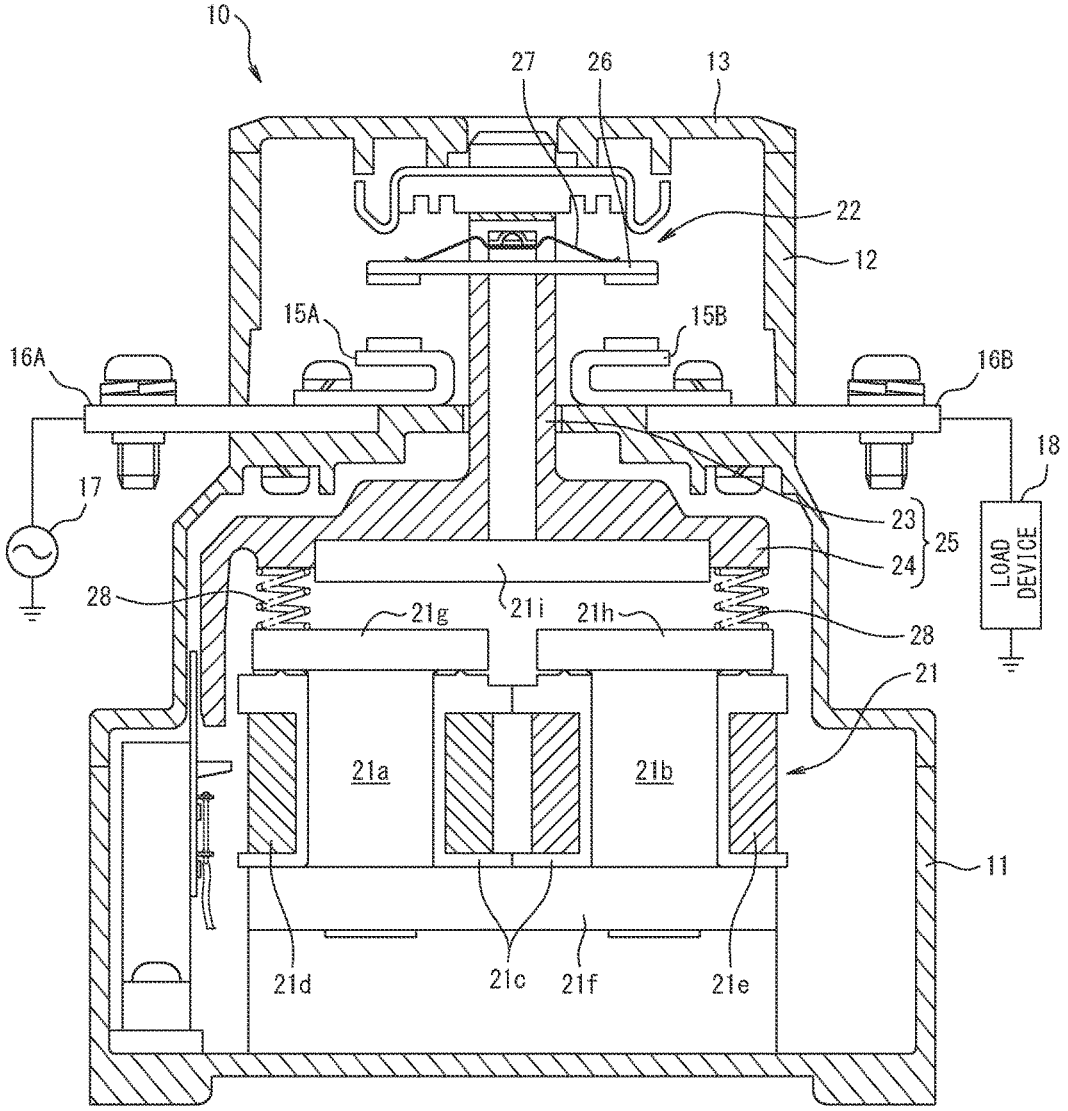
FIG. 1 is a cross-sectional view of an open state illustrating one example of an electromagnetic contactor to which the present invention is applicable.

One embodiment of the present invention will now be described with reference to the drawings. In the following description of the drawings, the identical or similar reference numerals are assigned to the identical or similar parts. The drawings are schematic, and it should be noted that the relationship between a thickness and planer dimensions, the thickness proportion of each layer, and the like are different from real ones. Accordingly, specific thicknesses and dimensions should be determined with reference to the following description. Moreover, in between mutual drawings, it is obvious that parts are illustrated with different dimensional relationships and proportions.

Further, the following embodiments are exemplary devices and methods that embody the technical idea of the present invention, and do not specify the technical idea of the present invention to the materials, shapes, configurations, arrangements, and a similar matter of components described below. Various modifications can be added to the technical idea of the present invention within the technical scope specified by claims described in CLAIMS.

The following describes one aspect of an operation coil drive device of an electromagnetic contactor as a first embodiment of the present invention.

First, as illustrated in FIG. 1, an electromagnetic contactor 10 applicable to the present invention includes a lower case 11 made of an insulating material, an upper case 12, which is made of an insulating material mounted to an upper portion of the lowercase 11, and an extinction cover 13, which is made of an insulating material mounted covering an upper opening on the upper case 12.

At an intermediate wall of the upper case 12, a right and left pair of fixed contacts 15A and 15B and terminal plates 16A and 16B are fixed keeping predetermined intervals.

The fixed contact 15A and the terminal plate 16A are coupled to an external supply power 17, and the fixed contact 15B and the terminal plate 16B are coupled to a load device 18 such as an inverter, which drives an electrical device such as an electric motor.

An electromagnet device 21 is housed in a lower space, which is a space portion of the lower case 11 and a space portion on the lower side with respect to the intermediate wall of the upper case 12. This electromagnet device 21 includes a right and left pair of stator iron cores 21*a* and 21*b*, an operation coil 21*d*, which is wound around an outer periphery of the one stator iron core 21*a* via a coil holder 21*c*, an operation coil 21*e*, which is wound around an outer periphery of the other stator iron core 21*b* via the coil holder 21*c*, a york 21*f*, which is disposed abutting on lower end surfaces of the pair of stator iron cores 21*a* and 21*b*, magnetic pole plates 21*g* and 21*h*, which are disposed abutting on upper end surfaces of the pair of stator iron cores 21*a* and 21*b*, and a movable iron core 21*i*, which is disposed opposed to the magnetic pole plates 21*g* and 21*h*.

A movable contact point mechanism 22 is housed in an internal space interposing the intermediate wall in the upper case 12.

The movable contact point mechanism 22 includes a movable contact point holder 25, one plate-shaped movable contact 26, a contact pressure spring 27, and a plurality of return springs 28. The movable contact point holder 25 includes a contact point support 23 and a coupling portion 24, which fixes the movable iron core 21*i* of the electromagnet device 21, and is disposed vertically movable. The movable contact 26 is coupled to the upper portion of the movable contact point holder 25 and opposed to the fixed contacts 15A and 15B from the above. The contact pressure spring 27 is coupled to the upper portion of the contact point support 23 and adds a spring biasing force downward to the movable contact 26. The return springs 28 are disposed between the magnetic pole plates 21*g* and 21*h* and the coupling portion 24 to urge the movable iron core 21*i* in a direction separating from the stator iron cores 21*a* and 21*b*.

The electromagnetic contactor 10 with the configuration flows the current to the operation coils 21*d* and 21*e* of the stator iron cores 21*a* and 21*b* in the open state where the movable contact 26 separates from the fixed contacts 15A and 15B upward illustrated in FIG. 1 to generate a strong magnetic flux by magnetic permeability of the stator iron cores 21*a* and 21*b*. The strong magnetic flux generated in the stator iron cores 21*a* and 21*b* generates attraction force to the movable iron core 21*i* in the stator iron cores 21*a* and 21*b*. The attraction force is proportionate to a product of a coil current flowing through the operation coils 21*d* and 21*e* and the number of windings of winding wires wound around the operation coils 21*d* and 21*e*.

Figure 2:
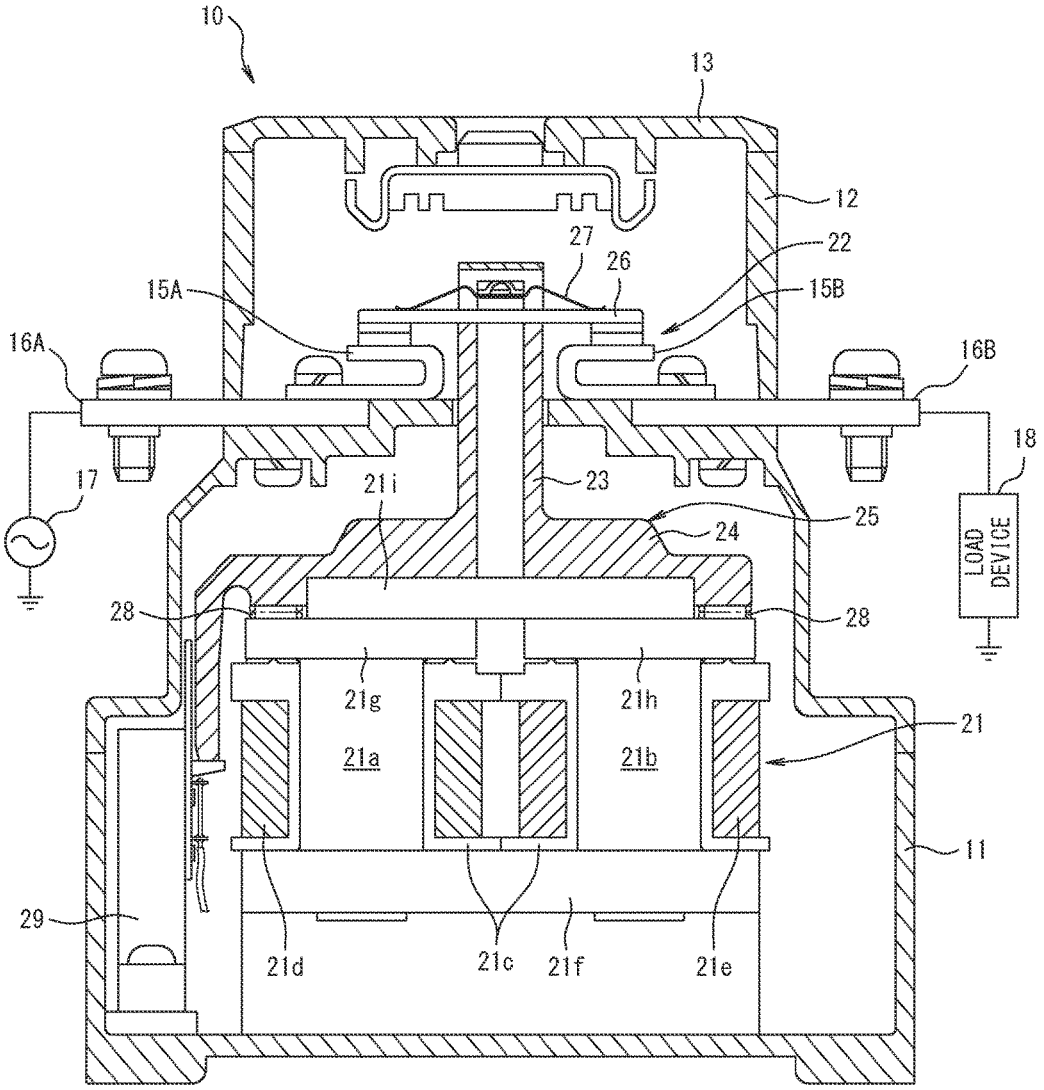
FIG. 2 is a cross-sectional view of a closed state illustrating one example of the electromagnetic contactor to which the present invention is applicable.

After the elapse of a certain period after starting driving the operation coils 21*d* and 21*e*, the attraction force generated in the stator iron cores 21*a* and 21*b* attracts the movable iron core 21*i* downward. Then, as illustrated in FIG. 2, the movable contact 26 contacts the fixed contacts 15A and 15B with a contact pressure from the contact pressure spring 27. In view of this, the electromagnetic contactor 10 enters the closed state and the electric power from the external supply power 17 is supplied to the load device 18.

Figure 3:
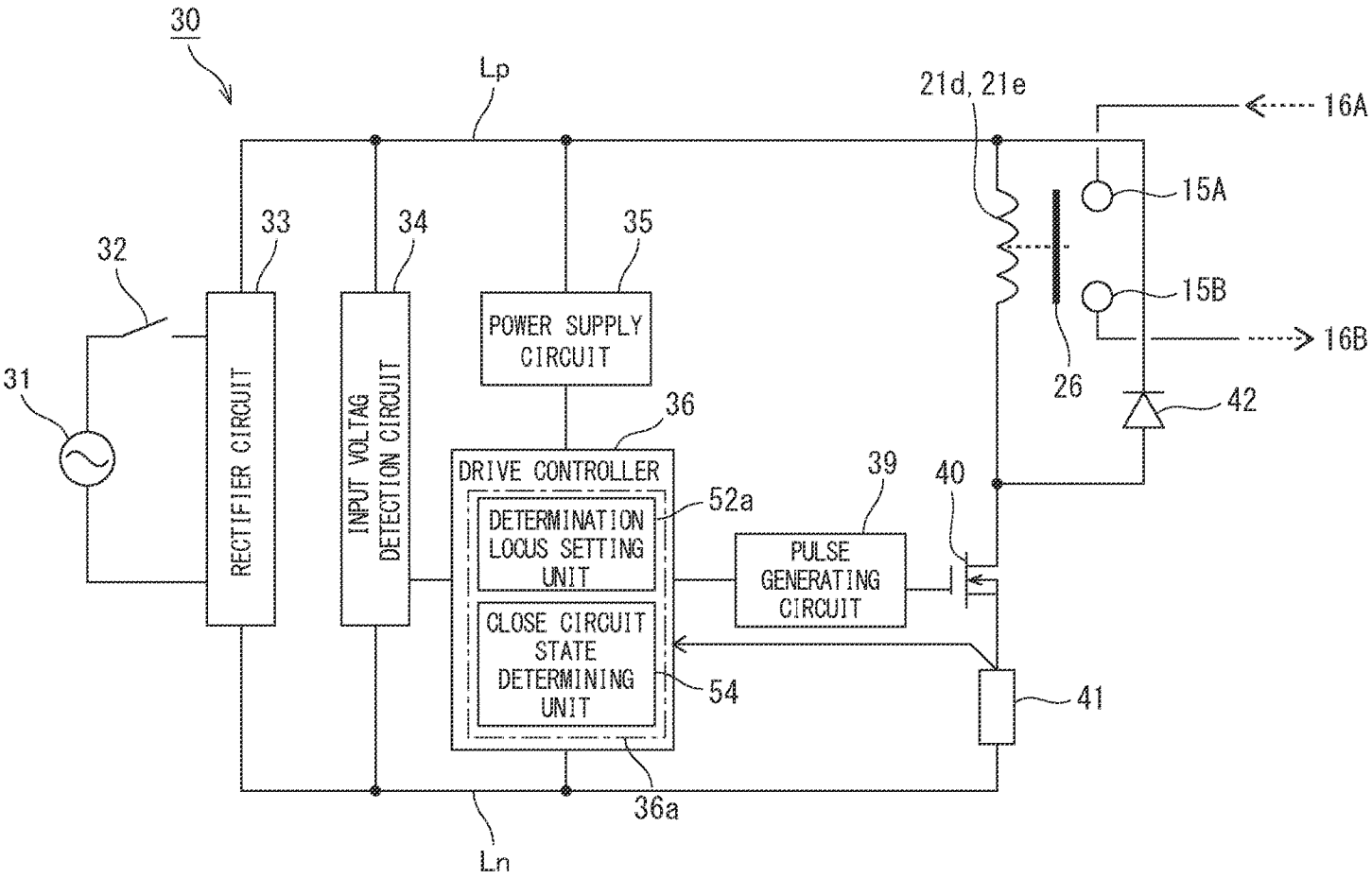
FIG. 3 is a block diagram illustrating an operation coil drive device.

The electromagnetic contactor 10 incorporates an operation coil drive device 30 illustrated in FIG. 3 to flow the current to the operation coils 21*d* and 21*e*.

This operation coil drive device 30 includes a rectifier circuit 33 to which a coil power supply 31 as a single-phase AC power supply or a three-phase AC power supply is coupled via an operation switch 32. The operation switch 32 is controlled by an external switching signal that controls the electromagnetic contactor 10 between an on-state (the closed state) and an off-state (the open state). The rectifier circuit 33 is constituted of rectifier diodes or similar components by the number according to a form of the coil power supply 31. The rectifier circuit 33 supplies an AC voltage produced by rectifying the AC voltage to the following respective circuits via a positive-electrode side line Lp and a negative-electrode side line Ln.

The operation coil drive device 30 includes an input voltage detection circuit 34, which is coupled between the positive-electrode side line Lp and the negative-electrode side line Ln of the rectifier circuit 33, and a power supply circuit 35 and a drive controller 36, which are coupled between the positive-electrode side line Lp and the negative-electrode side line Ln. The input voltage detection circuit 34, for example, detects an output voltage from the rectifier circuit 33 using voltage dividing means with a resistive element and supplies the output voltage to the drive controller 36. The power supply circuit 35 is, for example, constituted of a voltage regulator circuit and converts a DC high voltage output from the rectifier circuit 33 into a DC low voltage used by the drive controller 36. Here, in the case where the DC voltage output from the rectifier circuit 33 is a DC low voltage usable by the drive controller 36, the power supply circuit 35 can be omitted.

Furthermore, the operation coil drive device 30 includes a semiconductor switching element 40 and a current detection resistive element 41 coupled to the operation coils 21*d* and 21*e* of the electromagnetic contactor 10, which are coupled between the positive-electrode side line Lp and the negative-electrode side line Ln of the rectifier circuit 33 in series, in series. That is, the one end of the operation coils 21*d* and 21*e* coupled in series is coupled to the positive-electrode side line Lp of the rectifier circuit 33. A high-electric potential side electrode of the semiconductor switching element 40 is coupled to the other end of the operation coils 21*d* and 21*e*. The current detection resistive element 41 is coupled between the low-electric potential side electrode of the semiconductor switching element 40 and the negative-electrode side line Ln.

The operation coil drive device 30 includes a pulse generating circuit 39, which is coupled to a control electrode of the semiconductor switching element 40. A duty ratio signal SDuty output from the drive controller 36 is input to the pulse generating circuit 39.

To the operation coils 21*d* and 21*e*, a diode element 42 constituting a reflux circuit is coupled in parallel.

The operation coil drive device 30 with the configuration is a circuit that appropriately controls the coil current supplied to the operation coils 21*d* and 21*e* of the electromagnet device 21.

Here, the operation coil drive device 30 generally drives the operation coils 21*d* and 21*e* such that the movable iron core 21*i* is attracted to the stator iron cores 21*a* and 21*b* and further drives the operation coils 21*d* and 21*e* so as to maintain the attracted state.

The control to cause the movable iron core 21*i* to be attracted to the stator iron cores 21*a* and 21*b* is referred to as a close circuit control and the control to maintain the subsequent attracted state is referred to as a holding control.

The control to separate the movable iron core 21*i* from the stator iron cores 21*a* and 21*b* is referred to as an open circuit control.

The semiconductor switching element 40, for example, can be achieved by a Metal Oxide Semiconductor-Field Effect Transistor (MOS-FET) and a bipolar transistor. In the case of an N type MOS-FET, the control electrode of the semiconductor switching element 40 is equivalent to a gate terminal, the high-electric potential side electrode is equivalent to a drain terminal, and further the low-electric potential side electrode is equivalent to a source terminal.

The semiconductor switching element 40 switches the output DC voltage from the rectifier circuit 33 by an on/off pulse signal from the pulse generating circuit 39. Thus, the coil current flows to the operation coils 21*d* and 21*e*. At this time, a voltage by an amount of subtracting a saturated voltage of the semiconductor switching element 40 and both-end voltages of the current detection resistive element 41 from the output voltage from the rectifier circuit 33 occurs in both terminals of the operation coils 21*d* and 21*e*.

Note that, generally, an element having the saturated voltage sufficiently smaller than the output voltage from the rectifier circuit 33 is selected as the semiconductor switching element 40. This allows preventing element damage due to an influence from a package thermal resistance that the semiconductor switching element has. Taking a package heat-resistant temperature of the current detection resistive element 41 with a resistance x a square of current into consideration, a small resistance value is selected such that the current detection resistive element 41 withstands the large current flowing through the operation coils 21*d* and 21*e* at the pulse input. Furthermore, the resistance value is selected such that a both-terminal voltage of the current detection resistive element 41 becomes sufficiently smaller than the output voltage from the rectifier circuit 33.

The semiconductor switching element 40 switches the output DC voltage from the rectifier circuit 33 with the on/off pulse signal supplied from the pulse generating circuit 39. Thus, the coil current flows through the operation coils 21*d* and 21*e*. The magnitude of the coil current is settled by the power supply voltage, the resistance value and an inductance value of the operation coils 21*d* and 21*e*, and the on-period of the semiconductor switching element 40. The current detection resistive element 41 detects the coil current flowing through the operation coils 21*d* and 21*e* and outputs the coil current to the drive controller 36.

Figure 4:
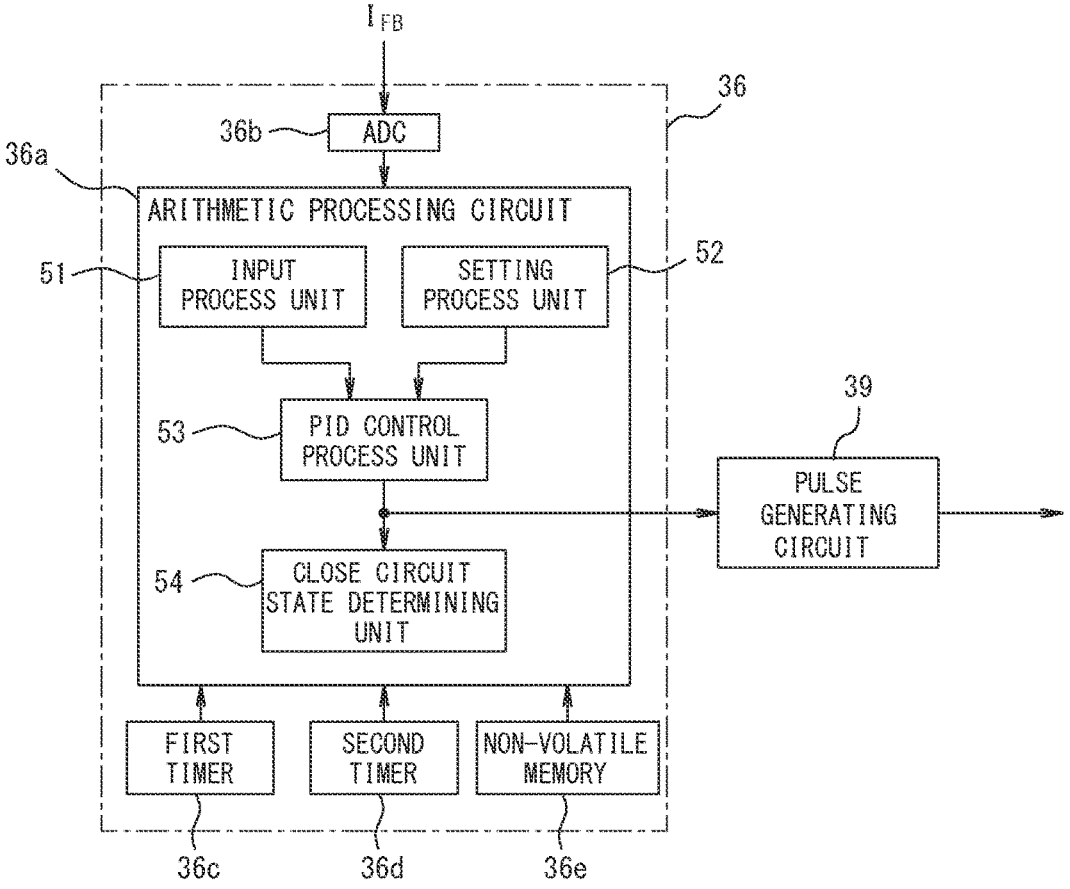
FIG. 4 is a block diagram illustrating a specific configuration of a drive controller in FIG. 3.

The drive controller 36 performs the close circuit control, which causes the movable iron core 21*i* to be attracted to the stator iron cores 21*a* and 21*b*, the holding control, which maintains the subsequent attracted state, and the open circuit control, which releases the movable iron core 21*i* from the stator iron cores 21*a* and 21*b*. As the specific configuration, as illustrated in FIG. 4, this drive controller 36 includes an arithmetic processing circuit 36*a*, which is, for example, constituted of a microprocessor, to accurately measure variation factors other than the power supply voltage such as the variation of the resistance values of the operation coils 21*d* and 21*e* and the change in the operation coil resistance due to the coil temperature rise.

The drive controller 36 includes an analog/digital converter (hereinafter described as an ADC) 36*b*, which converts the coil current becoming an analog voltage input from the current detection resistive element 41 into a digital signal. Furthermore, the drive controller 36 includes at least two pieces of a first timer 36*c* and a second timer 36*d* to provide the arithmetic processing circuit 36*a* and the pulse generating circuit 39 with a pulse-width modulation (PWM) control function. Among the timers, the first timer 36*c* is preferably used as a timer to settle a PWM cycle and the cycle preferably exceeds several tens of KHz outside an audio frequency.

The second timer 36*d* is used to settle the period from turning on the semiconductor switching element 40 until exciting the operation coils 21*d* and 21*e*. In this case, in the close circuit control, an on/off time ratio (or a duty ratio) of the semiconductor switching element 40 for exciting the operation coils 21*d* and 21*e*, specified relative to the settled PWM cycle by the first timer 36*c* is set large during the close circuit control and set small during the holding control.

The drive controller 36 includes a non-volatile memory 36*e* coupled to the arithmetic processing circuit 36*a*. This non-volatile memory 36*e* stores a control map representing a determination locus, which will be described later.

Figure 5:
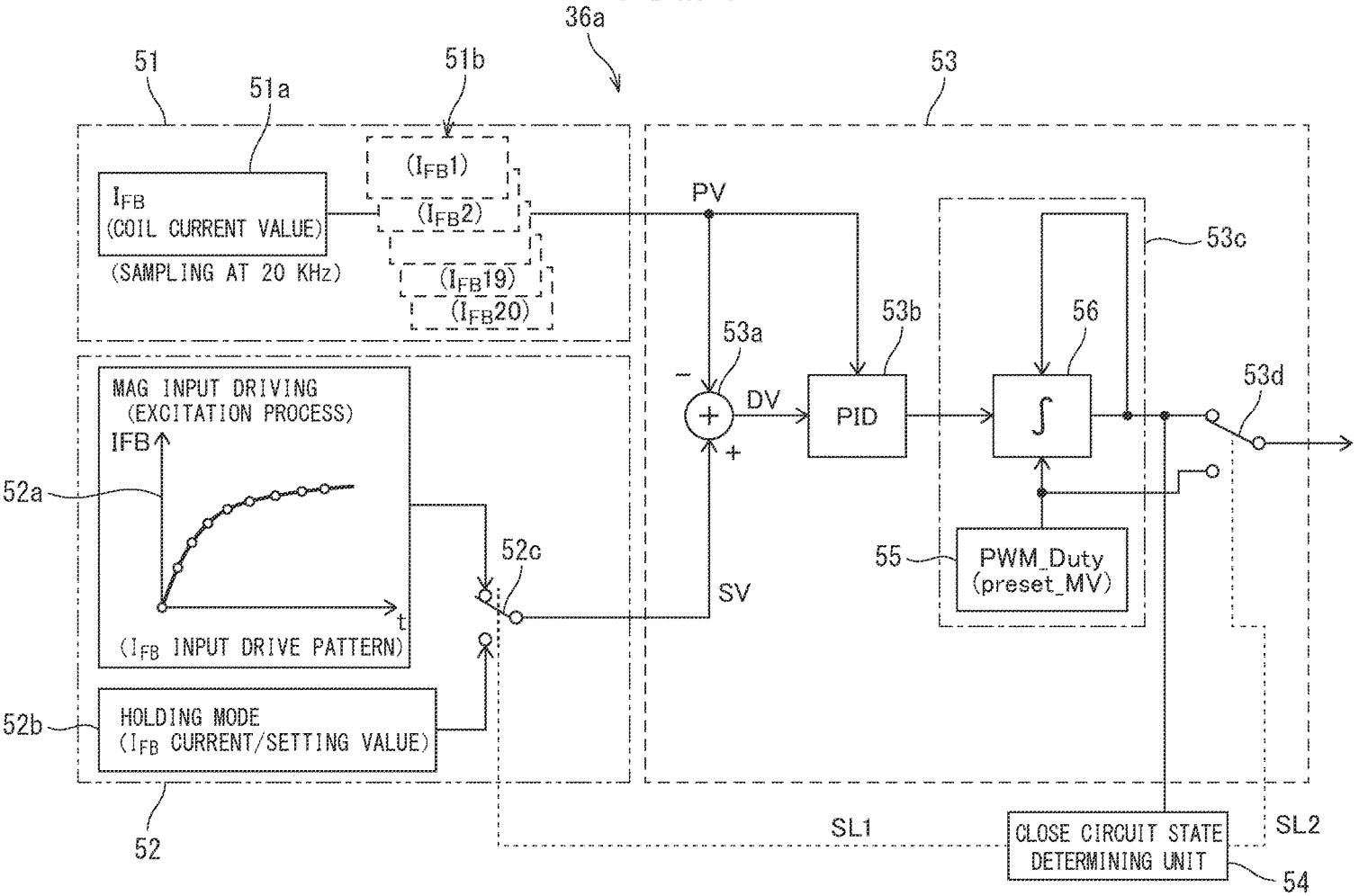
FIG. 5 is a function block diagram of an arithmetic processing circuit in FIG. 4.

Expressing the specific configuration of the arithmetic processing circuit 36*a* by a function block, as illustrated in FIG. 5, the arithmetic processing circuit 36*a* includes an input process unit 51, a setting process unit 52, a PID control process unit 53, and a close circuit state determining unit 54.

The input process unit 51 includes a current input unit 51*a* and a moving average operator 51*b*. The current input unit 51*a* inputs a coil current detection value $I_{FB}$ of the analog voltage output from the current detection resistive element 41 at every sampling cycle with the sampling cycle set to, for example, 20 kHz via the ADC 36*b*. The moving average operator 51*b* performs moving average on the 20 coil current detection values $I_{FB}$ input from the current input unit 51*a*. Accordingly, the moving average value of the coil currents is output as a coil current measurement value PV(k) at every 1 kHz from this moving average operator 51*b*.

The setting process unit 52 includes a determination locus setting unit 52*a* used for the close circuit control, a holding control setting unit 52*b* used for the holding control, and a selection switch 52*c*. The determination locus setting unit 52*a* refers to an input drive pattern, which represents a current change locus made to correspond to a locus of the coil current flowing through the operation coils 21*d* and 21*e* during the close circuit control, and outputs a coil current setting value as a coil current setting value SV. The holding control setting unit 52*b* outputs a coil current setting value for the holding control at a constant current value as the coil current setting value SV during the holding control. The selection switch 52*c* selects the determination locus setting unit 52*a* while a selection signal SL, which will be described later, from the close circuit state determining unit 54 is in a high level and selects the holding control setting unit 52*b* while the selection signal SL is in a low level, and the coil current setting value SV is output to the PID control process unit 53.

The PID control process unit 53 includes a subtractor 53*a*, a PID operator 53*b*, and a drive signal formation unit 53*c*. To the subtractor 53*a*, the coil current measurement value PV(k) output from the input process unit 51 and the coil current setting value SV(k) output from the setting process unit 52 are input. The subtractor 53*a* subtracts the coil current measurement value PV(k) from the coil current setting value SV(k) to calculate a current deviation DV (k) and outputs the calculated current deviation DV (k) to the PID operator 53*b*.

To the PID operator 53*b*, the current deviation DV (k) is input from the subtractor 53*a* and the coil current measurement value PV(k) is input from the input process unit 51 directly. The PID operator 53*b* performs the following operation of Formula (1) to calculate a difference ΔMV(k) of the operation output and outputs the calculated difference ΔMV(k) to the drive signal formation unit 53*c*.

[Formula 1]

$$\Delta MV(k) = \frac{1}{P}\left[DV(k) - DV(k-1) + \frac{DT}{T_I}DV(k) + \frac{T_D}{DT}(PV(k) - 2PV(k-1)PV(k-1))\right] \quad (1)$$

Here,

ΔMV(k−1): difference between k sampling period and "an operation output amount" of k−1 sampling period DV (k): deviation of the k sampling period (PV(k)−SV (k))

PV(k): output from the input process unit 51 (coil current $I_{FB}$ measurement value)

SV(k): output from the setting process unit 52 (coil current $I_{FB}$ setting value)

P: constant of proportion (P parameter)

$T_I$: integral time (I parameter)

$T_D$: differential time (D parameter)

DT: sampling period

The drive signal formation unit 53*c* is constituted of a preset duty ratio setting unit 55 and an integration operator 56. The preset duty ratio setting unit 55 sets a preset duty ratio (PWM_Duty) MVs of a pulse-width modulation (PWM) signal. To the integration operator 56, the difference ΔMV in the operation output amounts is input from the PID operator 53*b* and the preset duty ratio MVs is input from the preset duty ratio setting unit 55. The integration operator 56 integrates (adds) the difference ΔMV in the operation output amounts with the preset duty ratio MVs as the initial value to calculate a manipulated variable, namely, the duty ratio of the pulse-width modulation signal (hereinafter referred to as a PWM duty ratio) MV.

Here, regarding the PWM duty ratio calculated by the drive signal formation unit 53*c*, for example, the PWM duty ratio at a voltage 70% of the minimum voltage of a usage rating is set to less than 100% at the start of the close circuit control. Further, the PWM duty ratio at a voltage 120% of the maximum voltage of the usage rating is set so as to exceed 0%. Thus, controlling the PWM duty ratio so as to match the current locus of the operation coils 21*d* and 21*e* at the wide-range power supply voltage in the actual usage ensures achieving the stable operation. Specifically, it is only necessary to use the PWM duty ratios found by performing a linear interpolation operation on the voltages using the PWM duty ratio relative to the voltage 70% of the minimum voltage of the usage rating and the PWM duty ratio relative to the voltage 120% of the maximum voltage of the usage rating.

The PWM duty ratio MV calculated by the drive signal formation unit 53*c* is output as a PWM signal $S_{PWM}$ to the pulse generating circuit 39 via one of input terminals of an output switch 53*d*. The preset duty ratio MVs is input to the other input terminal of the output switch 53*d*. This output switch 53*d* selects the drive signal formation unit 53*c* when a selection signal SL2 from the close circuit state determining unit 54 is in the high level and selects the preset duty ratio setting unit 55 when the selection signal SL2 is in the low level.

To the close circuit state determining unit 54, the PWM duty ratio MV output from the drive signal formation unit 53*c* and the coil current measurement value PV(k) output from the input process unit 51 are input.

While the PWM duty ratio MV is less than a preset threshold MVth, this close circuit state determining unit 54 outputs a selection signal SL1 in the high level to the selection switch 52*c* of the setting process unit 52 and outputs the selection signal SL2 in the high level to the output switch 53*d* of the PID control process unit 53.

When the PWM duty ratio MV becomes equal to or more than the threshold MVth, the close circuit state determining unit 54 stores the coil current measurement value PV(k) at the time in a memory incorporated into the arithmetic processing circuit 36*a* as a reference value PVb. Simultaneous with this, the close circuit state determining unit 54 determines the selection signal SL2 as the low level and switches the output switch 53*d* to the preset duty ratio setting unit 55 side.

Furthermore, when the coil current measurement value PV (k) exceeds the reference value PVb, the close circuit state determining unit 54 determines that the movable contact 26 completely enters a contact point closed state through a wipe state in which the movable contact 26 contacts the fixed contacts 15A and 15B and then is brought into pressure contact with the contact pressure spring 27. At this time, the close circuit state determining unit 54 outputs the selection signal SL1 in the low level to the selection switch 52*c* of the setting process unit 52 and outputs the selection signal SL2 in the high level to the output switch 53*d* of the PID control process unit 53.

Figure 6:
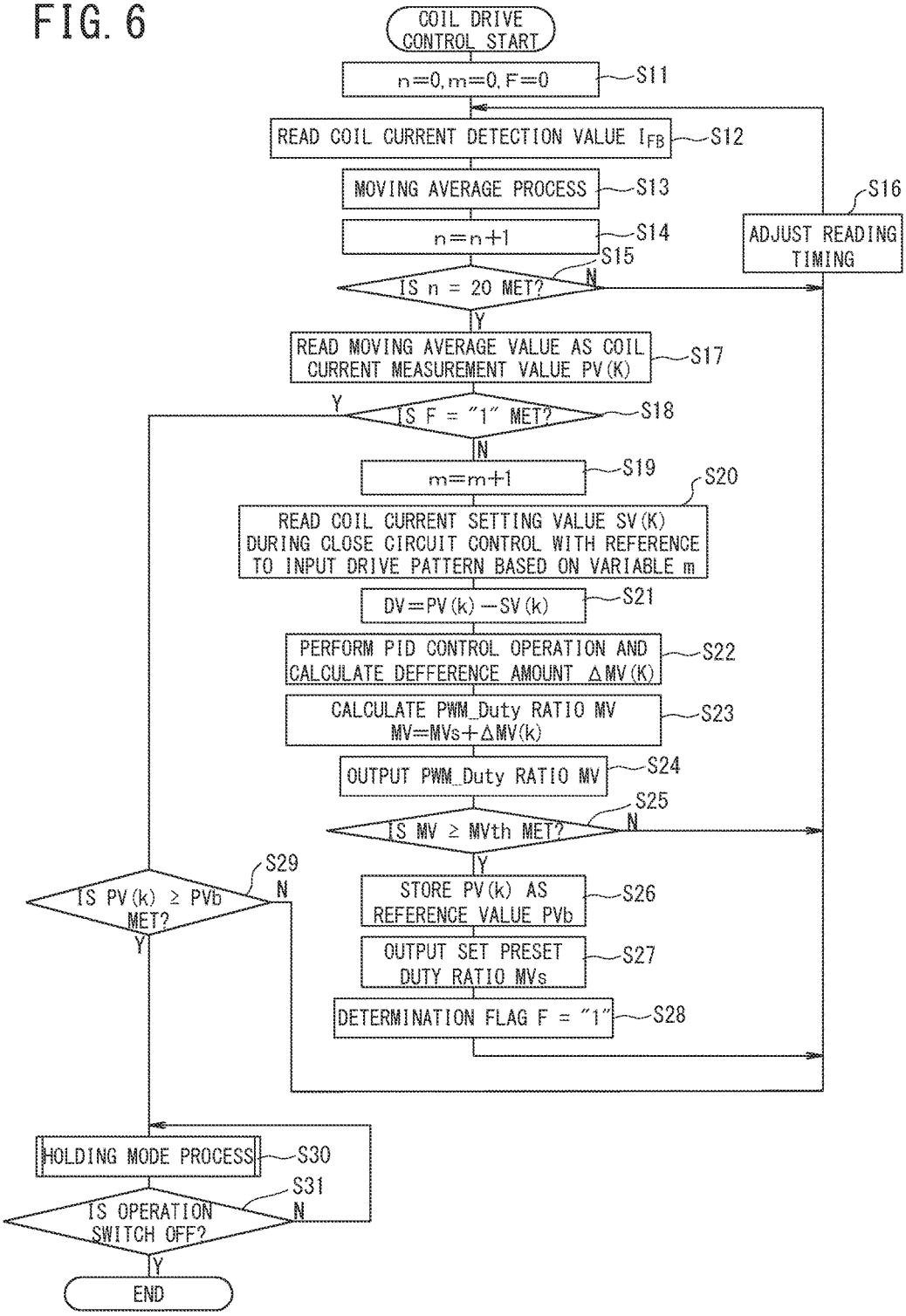
FIG. 6 is a flowchart illustrating one example of a coil driving control process procedure executed by the drive controller in FIG. 3.

The following describes the operation of the operation coil drive device 30 with reference to a flowchart in FIG. 6, which illustrates a coil driving control process executed by the arithmetic processing circuit 36*a* in the drive controller 36, and a timing chart in FIGS. 7A-7D.

First, the following describes the control map representing the locus of the change in the coil current during the close circuit control set by the setting process unit 52.

In a standard state, the electromagnetic contactor 10 is mounted to a mounting rail disposed horizontal to a vertical plate such as a switchboard by the lower case 11 with the terminal plate 16A upward and the terminal plate 16B downward. Accordingly, the movable iron core 21*i* is movable horizontally with respect to the stator iron cores 21*a* and 21*b*, and the movable contact point holder 25 is movable in the horizontal direction. An installation angle at this time is configured as ±0° with respect to the reference value.

In this standard state, in the state where the operation switch 32 is off and the operation coils 21*d* and 21*e* of the stator iron cores 21*a* and 21*b* are not energized, as illustrated in FIG. 1, the movable iron core 21*i* separates from the fixed contacts 15A and 15B by the return springs 28 in the release state. In view of this, the movable contact 26 also separates from the fixed contacts 15A and 15B in the open circuit state.

The following describes the general close circuit control operation in this state. With the operation switch 32 turned on, the drive controller 36 enters the operating state and outputs the PWM duty ratio MV to the pulse generating circuit 39, and the pulse generating circuit 39 outputs the on/off pulse signal to the semiconductor switching element 40. In view of this, by performing the on/off operation by the semiconductor switching element 40, as indicated by a characteristic line L0 illustrated by a thin solid line in FIG. 7A, the coil current according to the duty ratio flows through the operation coils 21*d* and 21*e*.

This coil current increases at a high rate of change in the initial state, and this generates the attraction force in the stator iron cores 21*a* and 21*b*. As illustrated in FIG. 7D, the movable iron core 21*i* starts moving to the stator iron cores 21*a* and 21*b* side against the return springs 28 at a time point t1.

Afterwards, the coil current once reaches a peak value at a time point t2 and then decreases, and during which the movable contact 26 contacts the fixed contacts 15A and 15B and then the movable contact 26 enters the wipe state in which the contact pressure by the contact pressure spring 27 acts. After that, at a time point t3, the movable contact 26 completely contacts the fixed contacts 15A and 15B, thus entering the contact point close circuit state.

In this contact point close circuit state, the coil current starts rising again and the holding control starts at a time point t4, thus reducing the coil current down to the holding current.

Thus, after rising up to the initial peak, the coil current once decreases and rises again, entering the saturated state. Subsequently, the coil current draws the locus where the coil current changes decreasing down to the holding current.

Figure 7A:
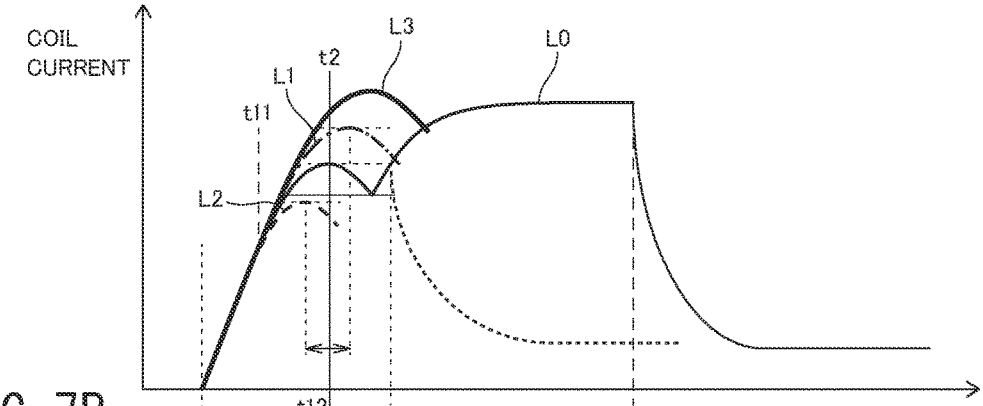
FIGS. 7A, 7B, 7C and 7D are signal waveform diagrams illustrating operations of the operation coil drive device in FIG. 3.

With the electromagnetic contactor 10 with the installation angle of +30° in which the movable contact 26 side is inclined upward with respect to the stator iron cores 21*a* and 21*b* side, at the start of the close circuit control, the peak value of the coil current in the initial state becomes high as indicated by a characteristic line L1, which is illustrated by the one dot chain line in FIG. 7A.

Conversely, with the electromagnetic contactor 10 with the installation angle of −30° in which the movable contact 26 side is inclined downward with respect to the stator iron cores 21*a* and 21*b* side, at the start of the close circuit control, the coil current peak value in the initial state lowers as indicated by a characteristic line L2, which is illustrated by the dotted line in FIG. 7A.

In view of this, to make the electromagnetic contactor 10 operable even in a poor installation state, the installation angle of +30° at which the peak value of the coil current becomes high, as illustrated in FIG. 7A, the coil current is set using the locus of a characteristic line L3, which is illustrated by the thick solid line and formed by providing a margin to the characteristic line L1, as the reference, at the close circuit control. This makes it possible to accurately operate the electromagnetic contactor 10 in all installation states.

In view of this, the locus equivalent to this characteristic line L3 is set to the control map of the determination locus setting unit 52*a* in the setting process unit 52, and the control map is stored in the non-volatile memory 36*e*. At this time, although the characteristic line L3 draws the locus decreasing after exceeding the peak value, as illustrated in FIG. 5, the locus is set as the locus gradually and continuously rising in which the period of the locus reaching the peak value is extended from before the peak value in the control map. Here, the horizontal axis of the control map indicates the number of times m to calculate the moving average value and the vertical axis indicates the coil current setting value SV.

The following describes the operation of this embodiment using the above-described control map.

For simplifying the explanation, it is assumed that the electromagnetic contactor 10 is installed at the installation angle of 0°, the standard installation state.

As described above, controlling the operation switch 32 to the on-state at the time point t1 in FIGS. 7A-7D enters the arithmetic processing circuit 36*a* in the drive controller 36 in the operating state and executes the coil driving control process illustrated in FIG. 6.

This coil drive control process first resets a variable n indicative of the number of processes to calculate the moving average value finally to zero, resets the variable m indicative of the number of times that the final moving average value is calculated to zero, and further resets a determination flag F described later to "0" (Step S11).

Next, the coil current detection value $I_{FB}$ is read as the terminal voltage of the current detection resistive element 41 in accordance with the sampling cycle (Step S12). The moving average process is performed based on the read coil current detection value $I_{FB}$ to calculate the moving average value (Step S13).

Next, after incrementing the variable n indicative of the number of times of performing the moving average process by "1," it is determined whether the variable n has reached the set value 20 or not (Step S15). When this determination result is n<20, the reading timing is adjusted until the next sampling cycle (Step S16), and the process returns to the above-described Step S12.

Meanwhile, when the number of moving averages n reaches 20, the set value, the moving average value calculated finally is read as the coil current measurement value PV(k) (Step S17), and then it is determined whether the determination flag F is set to "1" or not (Step S18). In this case, since the determination flag F is reset to "0" at Step S11, the process transitions to Step S19, and the number of times that the final moving average value is calculated, that is, the variable m, which indicates the number of times that the coil current measurement value PV(k) is calculated is incremented by "1" (Step S19).

Then, with reference to the input drive pattern, which is the locus representing the change in the coil current formed in the control map based on the variable m, the coil current setting value SV(k) is read (Step S20). Next, the coil current measurement value PV(k) is subtracted from the coil current setting value SV(k) to calculate a current deviation DV (k) of k sampling period: (=SV(k)−PV(k)) (Step S21). At this time, since the on/off driving has not been performed on the semiconductor switching element 40 yet and the coil current measurement value PV(k) is zero, the current deviation DV(k) becomes a positive value.

Next, based on the calculated current deviation DV(k) and the previous value DV (k−1) and the coil current measurement value PV(k) and the previous value PV (k−1), a PID operation of the above-described Formula (1) is performed (Step S22). Thus, the difference ΔMV(k) in the operation output amounts between the k sampling period and the previous k−1 sampling period is calculated (Step S22).

At this time, since both the current deviation DV(k−1) and the coil current measurement value PV(k−1) at the k−1 sampling period are both zero, the difference ΔMV(k) in the operation output amounts is calculated based on the current deviation DV (k) and the coil current measurement value PV(k) at the k sampling period.

Next, this difference ΔMV(k) in the operation output amounts is integrated with the preset duty ratio MVs as the initial value and the PWM duty ratio (PWM_Duty) MV is calculated (Step S23). The calculated PWM duty ratio MV is output to the pulse generating circuit 39.

In view of this, the pulse signal of the on/off time ratio according to the PWM duty ratio MV is output from the pulse generating circuit 39 to the gate electrode, which is the control electrode of the semiconductor switching element 40, and the switching control is performed on the semiconductor switching element 40. Consequently, as illustrated in FIG. 7A, the coil current starts flowing through the operation coils 21*d* and 21*e*.

Afterwards, the moving average value of the coil current detection value $I_{FB}$ is calculated at the cycle 1/20 of the sampling cycle. The moving average value is read as the coil current measurement value PV(k), and the variable m is incremented by "1". Therefore, the coil current setting value SV(k), which is calculated by referring to the input drive pattern in the control map, also increases, and the difference ΔMV(k) in the operation output amounts with the preset duty ratio MVs as the initial value maintains the positive value. Accordingly, the coil current flowing through the operation coils 21*d* and 21*e* continues increasing as illustrated in FIG. 7A.

Figure 7B:
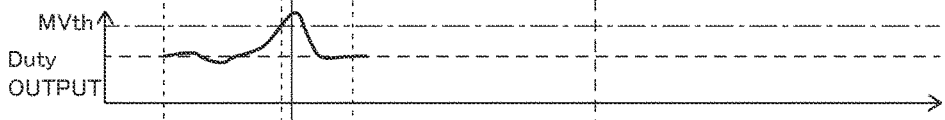
Figure 7C:
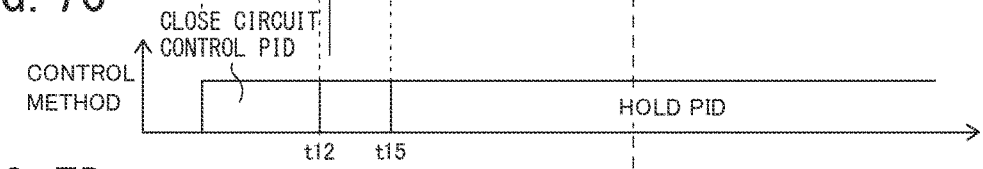
Figure 7D:
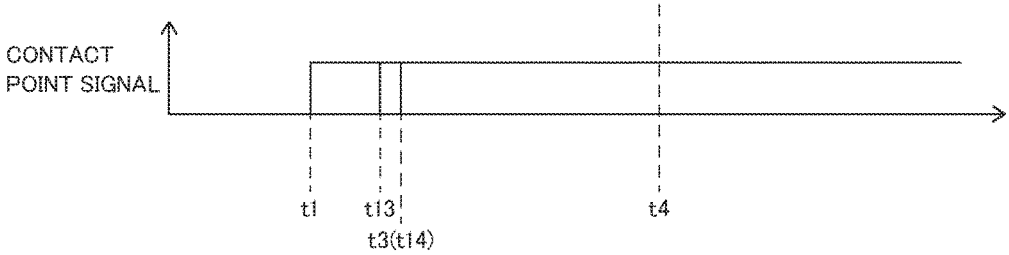

Since the coil current measurement value PV(k) also decreases as the rate of increase of the coil current starts decreasing at a time point t11, the difference ΔMV(k) in the operation output amounts also increases and the PWM duty ratio MV(k) calculated at Step S24 increases as illustrated in FIG. 7B.

At this time, since the calculated PWM duty ratio MV(k) is equal to or less than the preset threshold MVth, the process returns from Step S25 to Step S12 through Step S16 in the coil driving control process in FIG. 6. During this period, the movable iron core 21*i* is attracted to the stator iron cores 21*a* and 21*b* and starts moving rearward against the return springs 28. In accordance with this, the gap between the movable contact 26 and the fixed contacts 15A and 15B gradually decreases.

When the PWM duty ratio MV(k) exceeds the preset threshold MVth at a time point t12, the process transitions from. Step S25 to Step S26 in the coil driving control process in FIG. 6 and the coil current measurement value PV(k) read at the time point t12 is stored in a predetermined storage area in the memory as the reference value PVb (Step S26).

Next, the preset duty ratio MVs, which is preliminary set, is output to the pulse generating circuit 39 (Step S27), and then the determination flag F is set to "1" (Step S28), and the process returns to Step S12 through Step S16.

In view of this, when the moving average value is calculated and read as the coil current measurement value PV(k) next, the determination flag F is set to "1". Therefore, the process transitions from Step S18 to Step S29. It is determined whether the coil current measurement value PV(k) becomes equal to or more than the reference value PVb stored in the predetermined storage area in the memory or not (Step S29).

With the coil current measurement value PV(k) smaller than the reference value PVb, the process repeatedly returns to Step S12 through Step S16. During this period, as illustrated in FIG. 7D, the movable contact 26 enters the wipe state at a time point t13 in which the movable contact 26 contacts the fixed contacts 15A and 15B, and the movable contact point holder 25 moves rearward while the contact pressure by the contact pressure spring 27 is increased. Thereafter, at a time point t14, the movable contact 26 enters the contact point close circuit state in which the movable contact 26 completely contacts the fixed contacts 15A and 15B.

Afterwards, when the coil current measurement value PV(k) becomes equal to or more than the reference value PVb at a time point t15, it is determined that the movable contact 26 is in the contact point close circuit state and the process transitions to a holding mode process (Step S30). In this holding mode process, the PWM duty ratio is set to have the small value and the PID control operation similar to Step S20 to Step S24 is performed; therefore, the attracted state of the movable iron core 21*i* to the stator iron cores 21*a* and 21*b* is maintained at the small coil current. This holding control is repeated until the operation switch 32 turns off.

When the operation switch 32 turns off, the coil driving control process is terminated, the output of the PWM duty ratio MV(k) to the pulse generating circuit 39 is stopped, and the energization to the operation coils 21*d* and 21*e* is stopped. In view of this, the attraction force of the stator iron cores 21*a* and 21*b* disappears, and therefore the movable iron core 21*i* separates from the stator iron cores 21*a* and 21*b* by a repulsive force from the return springs 28, entering the release state. In accordance with this, the movable contact point holder 25 moves forward and the movable contact 26 separates from the fixed contacts 15A and 15B, entering the open circuit state.

Even when the installation angle of the electromagnetic contactor 10 becomes +30° and the coil current increases, since the input driving current pattern set to the determination locus setting unit 52*a* is set as the locus larger than the locus of the change in the coil current at the installation angle of +30°, the large variation of the PWM duty ratio MV generated when the coil current measurement value PV(k) deviates from the input driving current pattern can be reliably detected. Therefore, similar to the above-described standard installation state, the contact point close circuit state can be reliably detected and the state can reliably transition from the close circuit control state to the holding control state.

Furthermore, with the installation angle of the electromagnetic contactor 10 of −30°, similar to the above-described configuration, the contact point close circuit state can be accurately determined and the accurate transition from the close circuit control to the holding control is possible.

Moreover, since the state transitions from the close circuit control to the holding control immediately at the detection of the contact point close circuit state, an amount of consumption of the coil current flowing through the operation coils 21*d* and 21*e* becomes small.

In the coil driving control process in FIG. 6, the processes at Step S12 to Step S16 correspond to the input process unit 51, the processes at Step S19 and Step S20 and a part of the process at Step S30 correspond to the determination locus setting unit 52*a*, the processes at Step S17 and Step S19 to Step S24 correspond to the PID control process unit 53, and the processes at Step S25 to Step S29 correspond to the close circuit state determining unit 54.

Thus, the embodiment sets the change input driving current pattern indicative of the locus of the coil current change for the close circuit control to the determination locus setting unit 52*a*, performs the PID control operation on the current deviation DV between the coil current setting value SV(k) read from this input driving current pattern and the coil current measurement value PV(k), and calculates the PWM duty ratio MV. Then, the calculated PWM duty ratio MV is output to the pulse generating circuit 39 and the on/off driving is performed on the semiconductor switching element 40 to flow the coil current through the operation coils 21*d* and 21*e*. In view of this, using the large variation of the PWM duty ratio MV calculated by the PID control operation as the coil current measurement value PV(k) departs from the input driving current pattern and the current deviation DV increases, the close circuit state determining unit 54 can detect the large variation of this PWM duty ratio MVK. Accordingly, the contact point close circuit state can be accurately detected without the use of the position sensor and the timer.

The present invention is not limited to the configuration of the above-described embodiment, and various modifications are possible. For example, the semiconductor switching element 40 is not limited to the case interposed between the operation coils 21*d* and 21*e* and the negative-electrode side line Ln but may be interposed between the operation coils 21*d* and 21*e* and the positive-electrode side line Lp. Furthermore, the semiconductor switching element 40 may be interchanged with the current detection resistive element 41 to couple the operation coils 21*d* and 21*e*, the current detection resistive element 41, and the semiconductor switching element 40 in this order between the positive-electrode side line Lp and the negative-electrode side line Ln in series.

The embodiment describes the moving average process performed whenever the sampling of the coil current detection value $I_{FB}$ is performed by the input process unit 51; however, this should not be construed in a limiting sense. 20 pieces of the coil current detection values $I_{FB}$ may be stored and simple average may be performed on these coil current detection values $I_{FB}$.

While the embodiment describes the case of storing the input driving current pattern as the control map, this should not be construed in a limiting sense. The input driving current pattern may be stored as a two-dimensional linear equation and the coil current setting value SV(k) may be calculated through the operation.

The drive controller 36 is not limited to be constituted of the arithmetic processing circuit 36*a* such as the microprocessor but may be constituted in combination with, for example, a logic circuit, a comparator, and an arithmetic circuit.

Furthermore, the configuration of the electromagnetic contactor 10 is not limited to the configurations in FIGS. 1 and 2, as long as the movable contact is configured to be contactable with/separable from the other fixed contacts by the operation coils, the present invention is applicable to electromagnetic contactors with other various configurations.

REFERENCE SIGNS LIST

10 electromagnetic contactor,
11 lower case,
12 upper case,
13 extinction cover,
15A, 15B fixed contact,
16A, 16B terminal plate,
17 external supply power,
18 load device,
21 electromagnet device,
21*a*, 21*b* stator iron core,
21*c* coil holder,
21*d*, 21*e* operation coil,
21*f* york,
21*g*, 21*h* magnetic pole plate,
21*i* movable iron core,
22 movable contact point mechanism,
23 contact point support,
24 coupling portion,
25 movable contact point holder,
26 movable contact,
27 contact pressure spring,
28 return spring,
30 operation coil drive device,
31 coil power supply,
32 operation switch,
33 rectifier circuit,
34 input voltage detection circuit,
35 power supply circuit,
36 drive controller,
36*a* arithmetic processing circuit,
36*b* analog/digital converter (ADC),
36*c* first timer,
36*d* second timer,
36*e* non-volatile memory
37 coil voltage process circuit,
38 coil current process circuit,
39 pulse generating circuit,
40 semiconductor switching element,
41 current detection resistive element,
51 input process unit,
51*a* current input unit,
51*b* moving average operator,
52 setting process unit,
52*a* determination locus setting unit,
52*b* holding control setting unit,
52*c* selection switch,
53 PID control process unit,
53*a* subtractor,
53*b* PID operator,
53*c* drive signal formation unit,
53*d* output switch,
54 close circuit state determining unit,
55 preset duty ratio setting unit,
56 integration operator

The invention claimed is:

1. An operation coil drive device of an electromagnetic contactor, comprising:

an electromagnetic contactor including a movable contact disposed connectable to and separable from a fixed contact, the electromagnetic contactor being configured to apply a power supply voltage to an operation coil wound around a stator iron core by switching control, the stator iron core being configured to attract a movable iron core, the movable iron core being configured to cause the movable contact to move;

a current detector configured to detect a coil current flowing through the operation coil by the switching control; and a drive controller configured to control an on/off time ratio of a semiconductor switching element such that the on/off time ratio during a close circuit control becomes larger than the on/off time ratio during a holding control, the power supply voltage being switchingly applied to the operation coil at the on/off time ratio, wherein the drive controller includes:

a determination locus setting unit configured to set a determination locus that continuously increases along a change locus of the coil current detected by the current detector during the close circuit control; and a close circuit state determining unit configured to determine a contact point close circuit state by a contact of the movable contact to the fixed contact based on a deviation between the determination locus by the determination locus setting unit and the coil current detected by the current detector.

2. The operation coil drive device of the electromagnetic contactor according to claim 1, wherein the drive controller includes:

a PID control operator configured to perform a PID control operation on a deviation between a setting current based on the determination locus set by the determination locus setting unit and the coil current detected by the current detector to calculate an operation output amount; and a drive signal formation unit configured to operate the on/off time ratio of the semiconductor switching element based on the operation output amount by the PID control operator to output a duty ratio signal to the semiconductor switching element.

3. The operation coil drive device of the electromagnetic contactor according to claim 2, wherein the close circuit state determining unit is configured to determine an attracted state of the movable contact to the fixed contact based on the duty ratio signal output from the drive signal formation unit.

4. The operation coil drive device of the electromagnetic contactor according to claim 2, wherein when the duty ratio signal to be output is less than a preset threshold, the drive signal formation unit outputs the duty ratio signal based on the operation output amount, and when the duty ratio signal becomes equal to or more than the preset threshold, the drive signal formation unit outputs a fixed duty ratio signal in which the preset on/off time ratio is fixed.

5. The operation coil drive device of the electromagnetic contactor according to claim 4, wherein when the duty ratio signal output from the drive signal formation unit reaches the threshold, the close circuit state determining unit stores the coil current detected by the current detector in a storage unit as a reference value, and when the coil current detected by the current detector exceeds the reference value stored in the storage unit, the close circuit state determining unit determines a state as the contact point close circuit state.

6. The operation coil drive device of the electromagnetic contactor according to claim 5, wherein when the determination result by the close circuit state determining unit is the contact point close circuit state, the drive controller switches the close circuit control to the holding control.

7. The operation coil drive device of the electromagnetic contactor according to claim 1, wherein the determination locus setting unit is configured to set the locus of the change in the coil current configured to excite the operation coil in a form of extending a period regardless of a mounting state of the electromagnetic contactor during the close circuit control.

* * * * *